US005853571A

United States Patent [19]

Harris et al.

[11] Patent Number: 5,853,571

[45] Date of Patent: Dec. 29, 1998

[54] PYRITE DEPRESSANT USEFUL IN FLOTATION SEPARATION

[76] Inventors: Guy H. Harris, 1673 Georgia Dr., Concord, Calif. 94519; Douglas W. Fuerstenau, 1440 LeRoy Ave., Berkeley, Calif. 94708

[21] Appl. No.: 877,321

[22] Filed: Jun. 17, 1997

Related U.S. Application Data

[60] Provisional application No. 60/019,814 Jun. 17, 1996.

[51] Int. Cl.[6] ..... B03D 1/014; B03D 1/06; B03D 1/012; B03D 1/01

[52] U.S. Cl. ..... 209/167; 252/61

[58] Field of Search ..... 209/166, 167, 209/901; 252/61

[56] References Cited

U.S. PATENT DOCUMENTS

| | | |
|---|---|---|
| 2,336,868 | 12/1943 | Jayne . |
| 3,093,666 | 6/1963 | DuBrow . |
| 3,220,839 | 11/1965 | Herz . |
| 3,414,128 | 12/1968 | Baarson . |
| 3,426,896 | 2/1969 | Baarson . |
| 5,560,814 | 10/1996 | Burkhart . |

FOREIGN PATENT DOCUMENTS

| | | |
|---|---|---|
| 57-136957 | 8/1882 | Japan . |
| 59-92045 | 5/1984 | Japan . |

*Primary Examiner*—Thomas M. Lithgow
*Attorney, Agent, or Firm*—Harold D. Messner

[57] ABSTRACT

The present invention relates to a process for separating pyrite from sulfide ores and coal during flotation separation which comprises the depressing of pyrite with from about 0.05 to 0.75 kilograms per ton of concentrate solids using a pyrite depressant compounds selected from the group consisting of $$R1, R2, R3\ N^{+}O_2H_4SR4X^{-} \quad (I)$$

where R1, R2 and R3 are lower alkyls wherein the final sum of the carbon atoms is in a range of 3 to 6, R4 is selected from a group consisting of hydrogen (H) and amidine and X is chlorine, bromine or iodine, (II)

where Ro is a lower alkyl having carbon atoms in a range of 3 to 8 with 3 to 6 being preferred and a final pH in a range of 4 to 9 depending on the ore being processed, and therafter recovering the flotation concentrate thus obtained. As to group (I) compounds, 2-trimethylammonium-ethane isothiuronium dichloride (TMAE) as a pyrite depressant is surprisingly effective in pyrite removal being substantially independent of the pH values of the treated ore or coal, compatible with conventional collector reagents such as xanthates in the case of copper sulfide bearing ores as well as being substantially unobtrusive in not depressing other useful ore sulfides, including but limited to chalcopyrite, bornite chalcosite. Group (II) are more pH sensitive.

2 Claims, 7 Drawing Sheets

PYRITE DEPRESSANT USEFUL IN FLOTATION SEPARATION

RELATED APPLICATION

This is a continuation of Ser. No. 60/019,814 filed Jun. 17, 1996.

SCOPE OF THE INVENTION

The present invention relates to a depressant that is surprisingly effective in depressing pyrite during flotation separation of sulfide ores and coal and more particularly to surprisingly useful depressant that diverts surprisingly large amounts of pyrite on a normalized basis during removal of useful minerals of such ores and/or removal of contaminants (that includes, of course, pyrite) from coal.

BACKGROUND OF THE INVENTION

The need to depress pyrite during flotation of sulfide ores and/or coal is well known. With particular regard to the former, diverting the pyrite into waste material, significantly upgrades the concentrates of the resulting ores as well as reduces smelting costs since there less sulfur dioxide and sulfuric acid produced as byproducts. With particular regard to the need to depress pyrite in coal, calorific content is improved with its removal, as well as proving a concomitant reduction in sulfur emissions, enabling the user to more easily meet Federal and State regulations.

While a vast array of reagents for pyrite depression have been proposed and reported, we are unaware of use of 2-trimethylammonium-ethane isothiuronium dichloride (TMAE) as a pyrite depressant during both coal and copper sulfide flotation operations, and moreover, we are surprised by the effectiveness thereof in such operations. Families of such depressants are likewise effective.

SUMMARY OF THE INVENTION

The present invention relates to a process for separating pyrite from sulfide ores and coal during flotation separation which comprises the depressing of pyrite with from about 0.05 to 0.75 kilograms per ton of concentrate solids, using a pyrite depressant compounds selected from the group consisting of $$R1,\ R2,\ R3N^{+}C_2H_4SR4X^{-} \qquad (I)$$

where R1, R2 and R3 are lower alkyls wherein the final sum of the carbon atoms is in a range of 3 to 6, R4 is selected from a group consisting of hydrogen (H) and amidine and X is chlorine, bromine or iodine, and

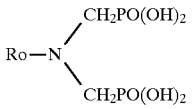

(II)

where Ro is a lower alkyl having carbon atoms in a range of 3 to 8 with 3 to 6 being preferred and a final pH in a range of 4 to 9 depending an the ore being processed and therafter recovering the flotation concentrate thus obtained. As to group compounds, 2-trimethylammonium-ethane isothiouronium dichloride (TMAE) as a pyrite depressant is surprisingly effective in pyrite removal, being substantially independent of the pH values of the treated ore or coal compatible with conventional collector reagents such as xanthates in the case of copper sulfide bearing ores as well as being substantially unobtrusive in not depressing other useful ore sulfides, including but limited to chalcopyrite, bornite, chalcosite, etc. Group (II) are more pH sensitive.

STRUCTURAL FORMULA 2-trimethylammonium-ethane isothiouronium dichloride (TMAE) has the following structural formula:

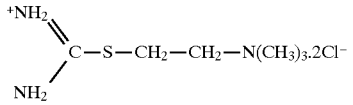

PREPARATION 2-trimethylammonium-ethane isothiouronium dichloride (TMAE) is obtained by the reaction of a 50 per cent aqueous solution of choline dichloride with a molar equivalent of thiourea in accordance with

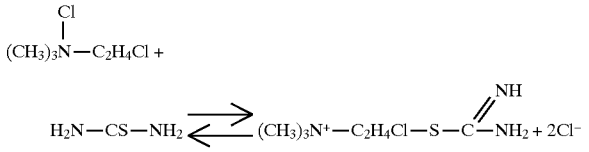

in more detail, 316 grams of a 50 per cent solution of choline dichloride with 83.6 grams of thiourea and 10 milliliters of concentrated hydrochloric acid. The solution is stirred and refluxed. The water is then removed by means of a rotary evaporator to give a cystalline mass of 90 per cent yield. Recrystallization is then carried out. The resulting 2-trimethylammonium-ethane isothiouronium dichloride (TMAE) is about 98% pure.

COAL FLOTATION EXPERIMENTS

Two step batch flotation tests for a high-sulfur bituminous coal sample (ILLINOIS NO. 6) was conducted in a conventional floatation machine with a two-paddle flotation cell. The first step was performed while maintaining the pulp level to a predetermined mark on the cell, using manual controls. Mechanical scrappers were adjusted to a speed between 0 and 40 rpm. Air flow was controlled by a diaphragm pump connected to a three-way valve and flowmeter assembly.

Table 1 shows the standard floatation test conditions in more detail. Note that purified dodecane was selected as the collector rather than kerosene to gain source independence. The frother was conventional MIBO (methylisobutylcarbinol or 4-methyl-2-penanol). The tailings were filtered, dried, weighed and analyzed.

The concentrate from first step was then re-floated. The pulp was conditioned for about 1 minute, with additional frother (MIBC) being added and conditioned for about 3 minutes (0.58 kg per ton; 0.07 kilograms per ton; and 0.07 kilograms per ton MIBC being added as frother for ILLINOIS NO. 6, PITTSBURGH NO. 8 and UPPER FREE- PORT coal samples, respectively). No collector added. After release of air, the froth was collected at different time intervals, viz. at 0.5, 1, 3 and 5 minutes after initialization had been completed.

Filtering, drying, weighing and analyze of the concentrates and tailings been occurred as shown in Table 2 for the above coal sample in per cent of pyritic sulfur rejection as a function of per cent of combustible material recovery (CMR).

Figure 1:
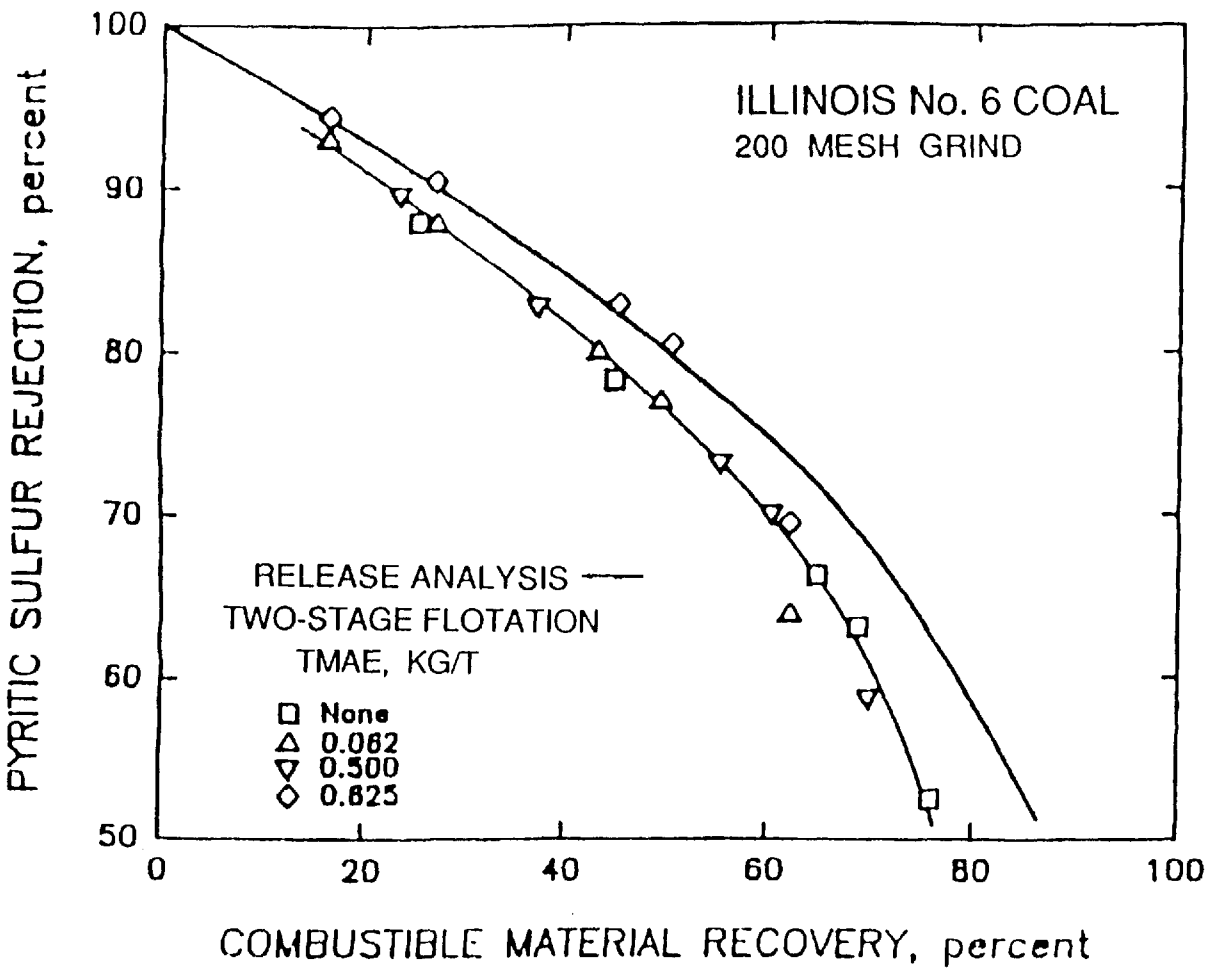
FIG. 1–2 and 4–7 show experimental results employing 2-trimethylammonium-ethane isothiouronium dichloride (TMAE)

In the case of the ILLINOIS NO. 6 sample, FIG. 1 shows that the presence of 2-trimethylammonium-ethane isothiouronium dichloride (TMAE) improved the pyritic sulfur rejection significantly (that is, with respect to results obtained in the absence of TMAE for this sample). That is to say, although little effect on pyritic sulfur rejection was note at low TMAE additions, viz. at 0.062 kilograms per ton of solids, at higher TMAE dosages say, over 0.05 kilograms per ton, the pyritic sulfur rejection increases to values closer to those obtained by release or analysis testing, a conventional testing procedure normalized to common collector and frother dosages.

(Release or tree analysis is a standard procedure to determine best possible separation with standard test conditions. In this procedure the initial feed is floated for 5 minutes in a standard floatation cell but with ¼ of the collector and frother dosages. This assures that most hydrophobic materials is floated first. The tailings are then subjected to a sequence of three more scavenging floatation steps. Each step requires an additional ¼ of both the collector and frother until the final tailings product is obtained. The concentrates generated by the successive flotation of the first second and third tailings are estimated to have a mass of more than 1% of the initial feed. These concentrates are then submitted to further cleaning. The initial floatation concentrate is also repeatedly floated until all entrapped mineral matter is removed. The tailings fractions associated with initial concentrate are also subjected to further cleaning steps. Both concentrates and tailing are kept separate for individual cleaning and scavenging. Mechanical floatation variables including floatation time are kept constant. Tree analysis is aimed at identifying best possible separation by floatation. A curve thus generated has a focus that represents (a) products of maximum coal matrix content (but minimum ash and pyritic sulfur content), (b) products of the minimum coal matrix content (but maximum ash and pyritic sulfur content) and all other intermediate products in between (a) and (b), supra. Of course collector and frother concentration for each coal sample correspond to that level used in the standard floatation test.)

It is believed TMEA adsorbs onto the pyritic surface by complexing iron, making the latter highly hydrophilic. In addition TEPA also appears to act as a amphoteric surfactant to modify the surface of both coal and pyrite increasing their positive charge at low TEPA dosages, dispersing the system and improving pyrite rejection as demonstrated by electrokentic, Hallimond tube floatation and rheological studies.

ORE FLOTATION EXPERIMENTS

OVERVIEW: In the flotation of copper-bearing ores, a collector such as potassium amyl xanthate is added to a slurry of the copper bearing ore. Purpose: to allow the copper sulfide mineral to become hydrophobic. But iron sulfide minerals (pyrite) may also adsorb the collector and float with the copper minerals. The present invention relates to depressant for such iron sulfide minerals during the flotation of copper sulfide ores without adversely affecting the effectiveness of the latter.

EXAMPLE I

Figure 2:
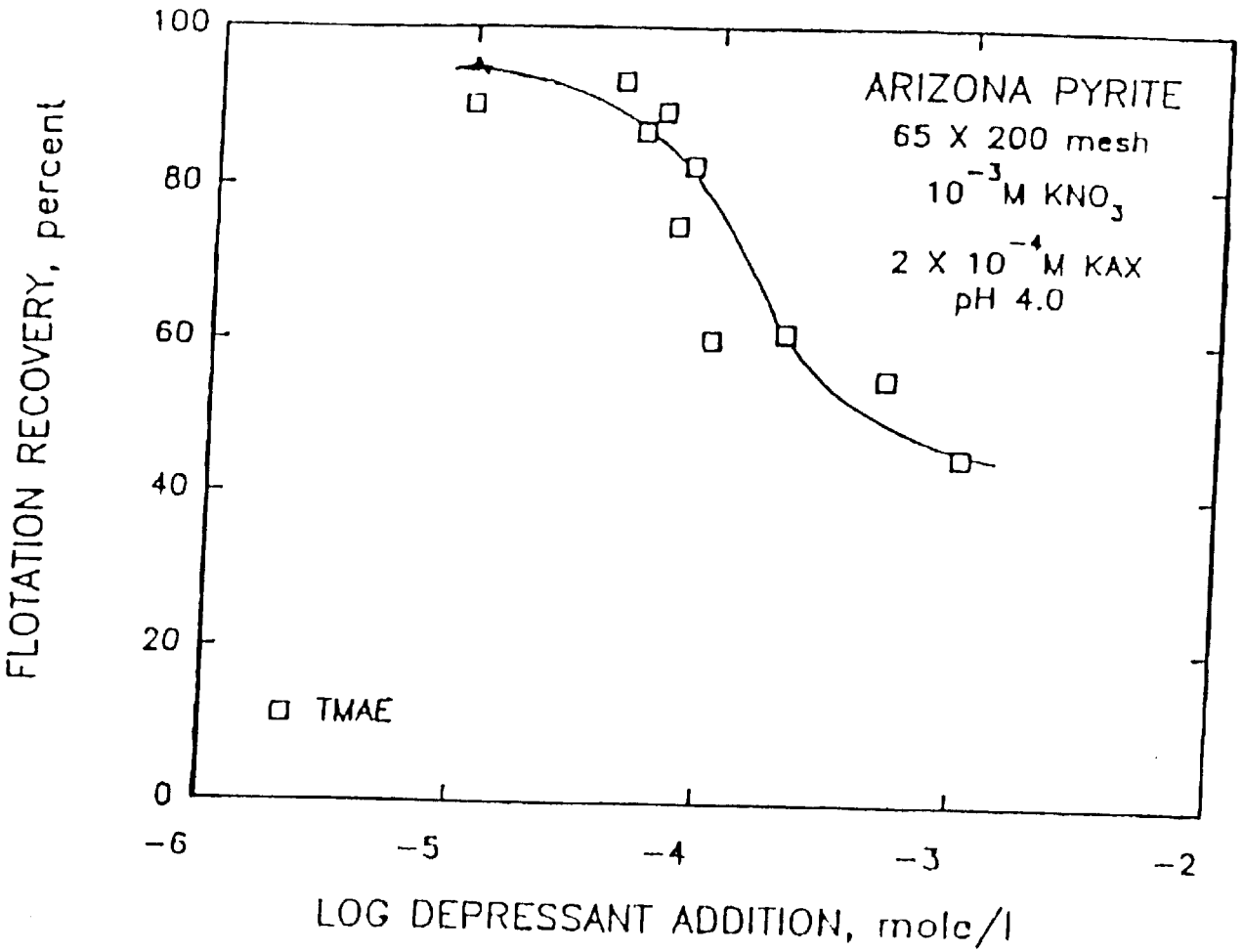
Figure 3:
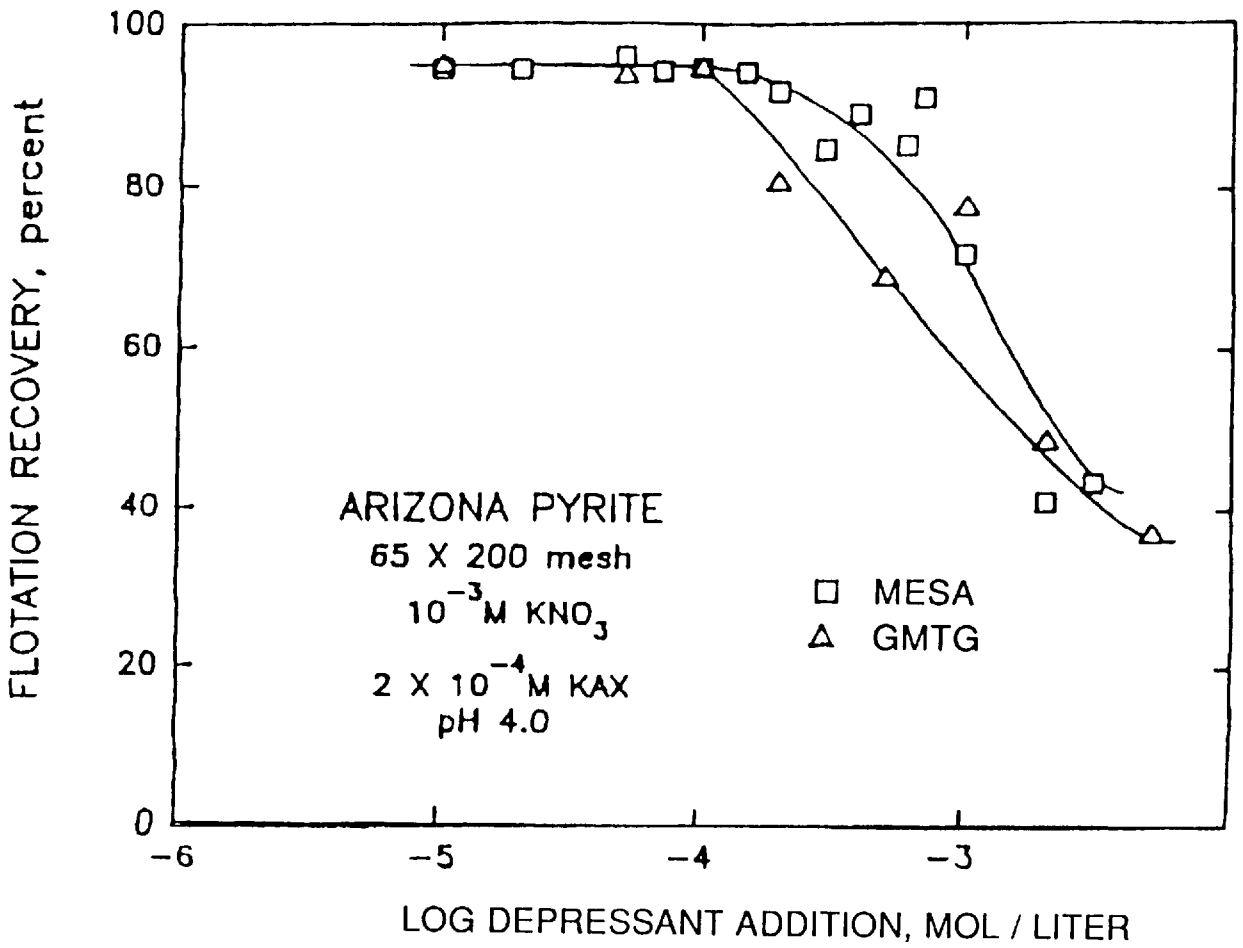
FIG. 3 shows experimental results of conventional pyrite depressants.

1×10−3 molar solution of potassium nitrate was prepared, adjusting the pH by additions of hydrogen nitrate and potassium hydroxide. A 65×200 mesh sample of a pyrite from Arizona was added to the solution and the resulting system conditioned for 7 minutes using a magnetic stirrer. After 4 minutes of conditioning, potassium amyl xanthate (KAX) was added and then the resulting suspension conditioned for three more minutes. For the evaluation of TMAE, TMAE was added to the suspension in amounts indicated in FIG. 2. After the suspension was conditioned to a pH of 4, a 2×10−4 molar solution of KAX was added. After final conditioning, the pH was recorded and the suspension was transferred to a modified Hallimond tube where the material was floated for one minute using a nitrogen flow of 50 cubic centimeters per minute. Both the concentrate and tailings were filtered, dried and weighted. Thereafter the tests were repeated using conventional pyritic depressants, viz., mercapto-ethane sulfonic acid (MESA) and glycerylmonothioglycolate (GMTG). These results are shown in FIG. 2 and 3. Note that TMAE is shown to react strongly with surface of pyrite as compared to MESA and about the same for GMTG, but requires less reagent for comparable depression. In addition to rendering the surface of pyrite hydrophilic by absorption, TNAE also appears to leach the surface of pyrite, increasing the amount of iron in bulk solution. Hence, some of the collector KAX may be consumed in the bulk, not leaving enough for the pyrite to float.

EXAMPLE II

A Temagami copper ore was prepared in a similar manner as the pyrite of EXAMPLE I, for comparison purposes. With TMAE added, the ore was floated and the tests shown in FIG. 4 obtained.

Figure 4:
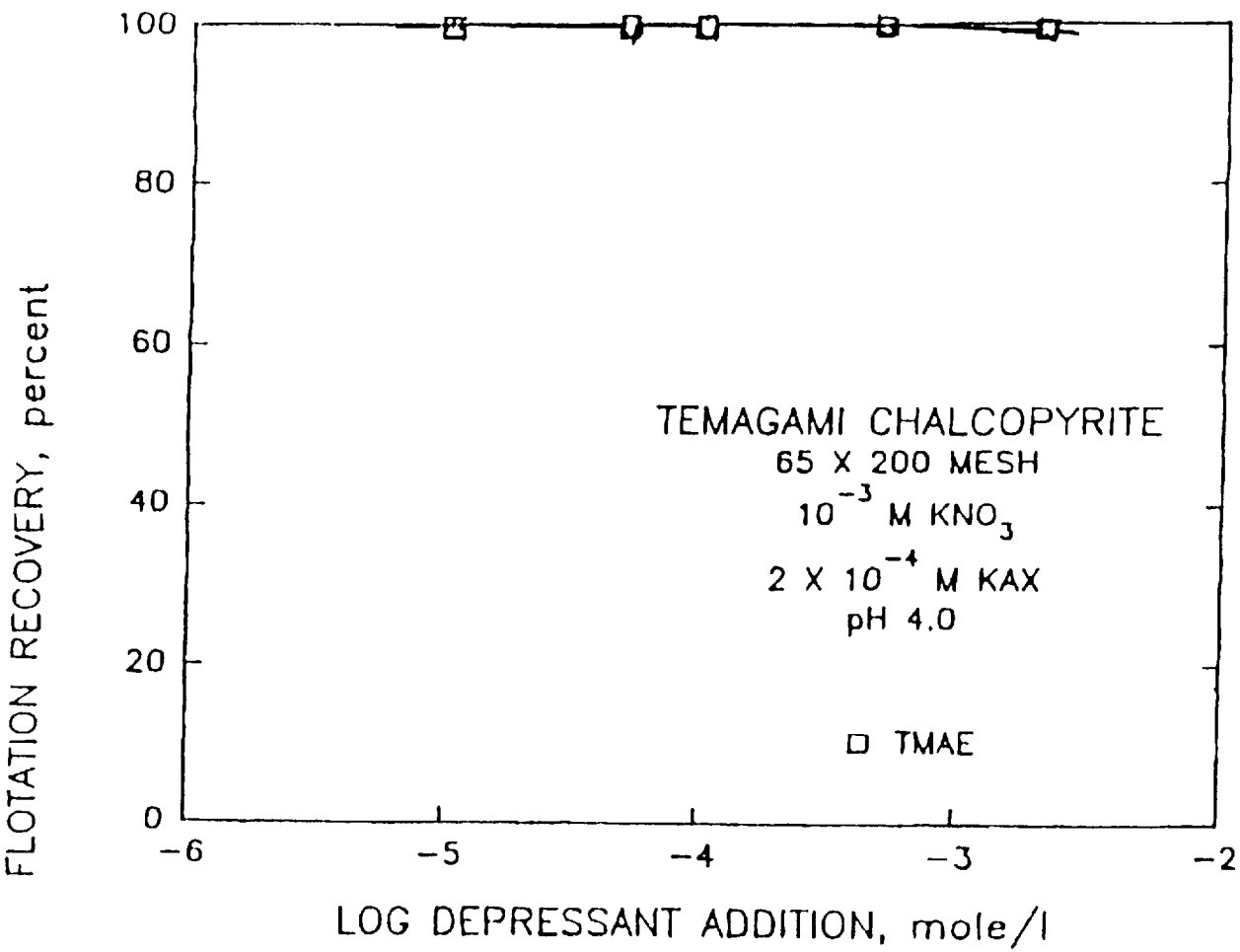

FIG. 4 indicates that TMAE does not affect the flotation behavior of the copper since no depression of the system is indicated. The selectivity of TMAE for pyrite only, is thus assured.

EXAMPLE III

A Southwestern U.S. copper ore (−10 mesh) was prepared by crushing. After blending and splitting the sample was divided in 500 gram subsamples (dry basis). Argon was used as purging gas. The subsample was then reground to 67 weight per cent solids content. For the evaluation of TMAE, 0.116 kilograms per ton of TMAE were added. After further conditioning, lime was added (0.2 to 0.4 kilograms per ton) to attain a pH of 9.5. A conventional collector was added (0.04 kilograms per ton Minerec M200).

Figure 5:
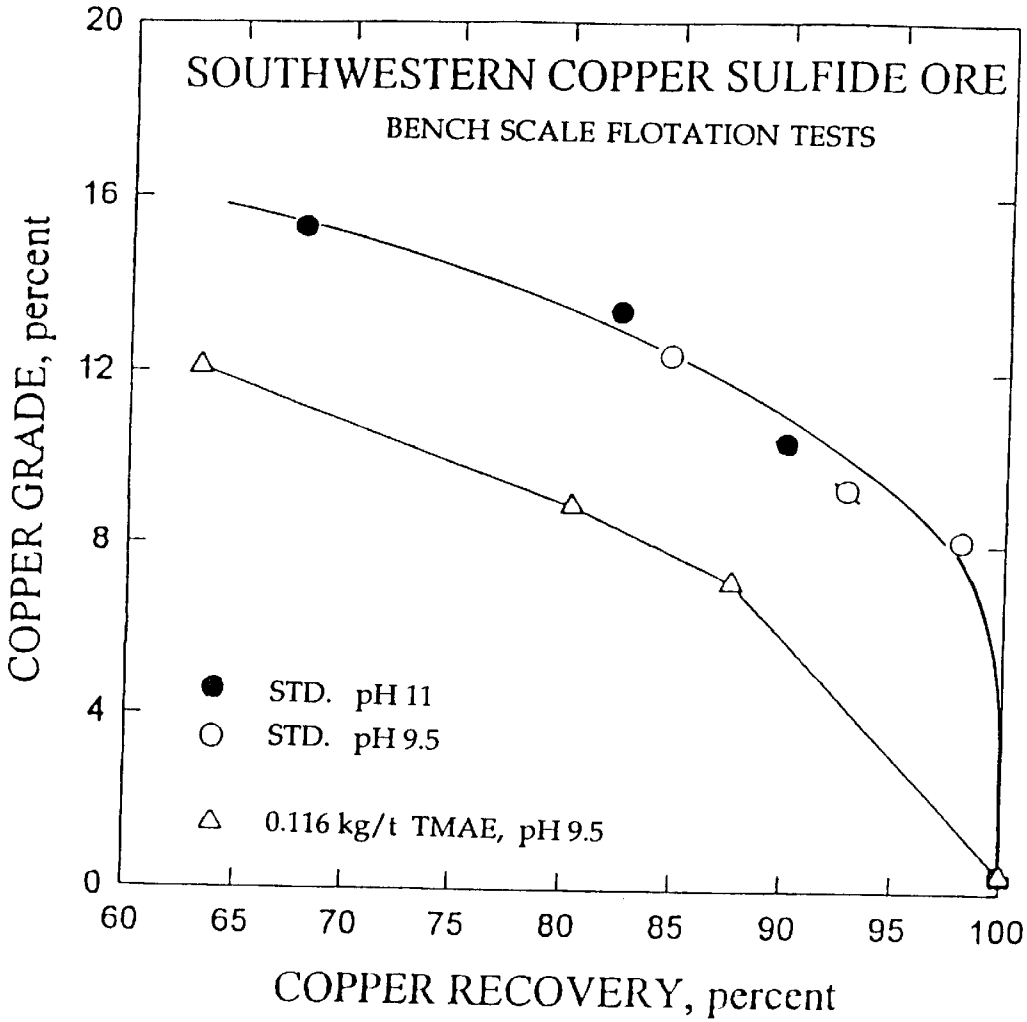

The slurry was then transferred to a conventional flotation machine. The pH was measured. Then, 0.012 kilogram per ton MIBC was added for 3 minutes. The sample was then floated. More collector and MIBO were added and conditioned. The sample was again floated. There was a repeat of the last mentioned step to obtain the final tailings. Three rougher concentrates collected separately arid tailing were filtered, dried, weighed and analyzed for copper and iron using a spectrophotomer. Metallurgical calculations were performed. Comparisons with MESA and/or GMTG as reagents were made as depicted in FIG. 5. An additional run at a pH of 11 for MESA and/or GMTG was also made and those results are also shown in FIG. 5.

FIG. 5 indicates that TMAE does not affect the flotation behavior of the copper since no depression of the system is indicated. The selectivity of TMAE for pyrite only, is thus assured.

EXAMPLE IV

A South American cooper ore was prepared in a manner akin to that set forth in EXAMPLE II with the following differences. In the grinding step, a 500 gram subsample was ground to a 80 per cent 200 mesh subsample. The pH was modified by the addition of lime at a rate of 0.2 kilograms per ton. No collector was used. The flotation tests were performed using 0.02 kilograms per ton of isopropyl xanthate (NalPX). A larger amount of MiBO was used (0.25 kilograms per ton). The system was floated for two minutes. At the next stages, 0.01 kilograms per ton of NaiPX was added and conditioned for about 4 minutes. Then 0.0125 kilograms per ton of MIBC was added and the slurry conditioned. Comparisons with MESA and/or GMTG as reagents Were made as depicted in FIG. 6.

Figure 6:
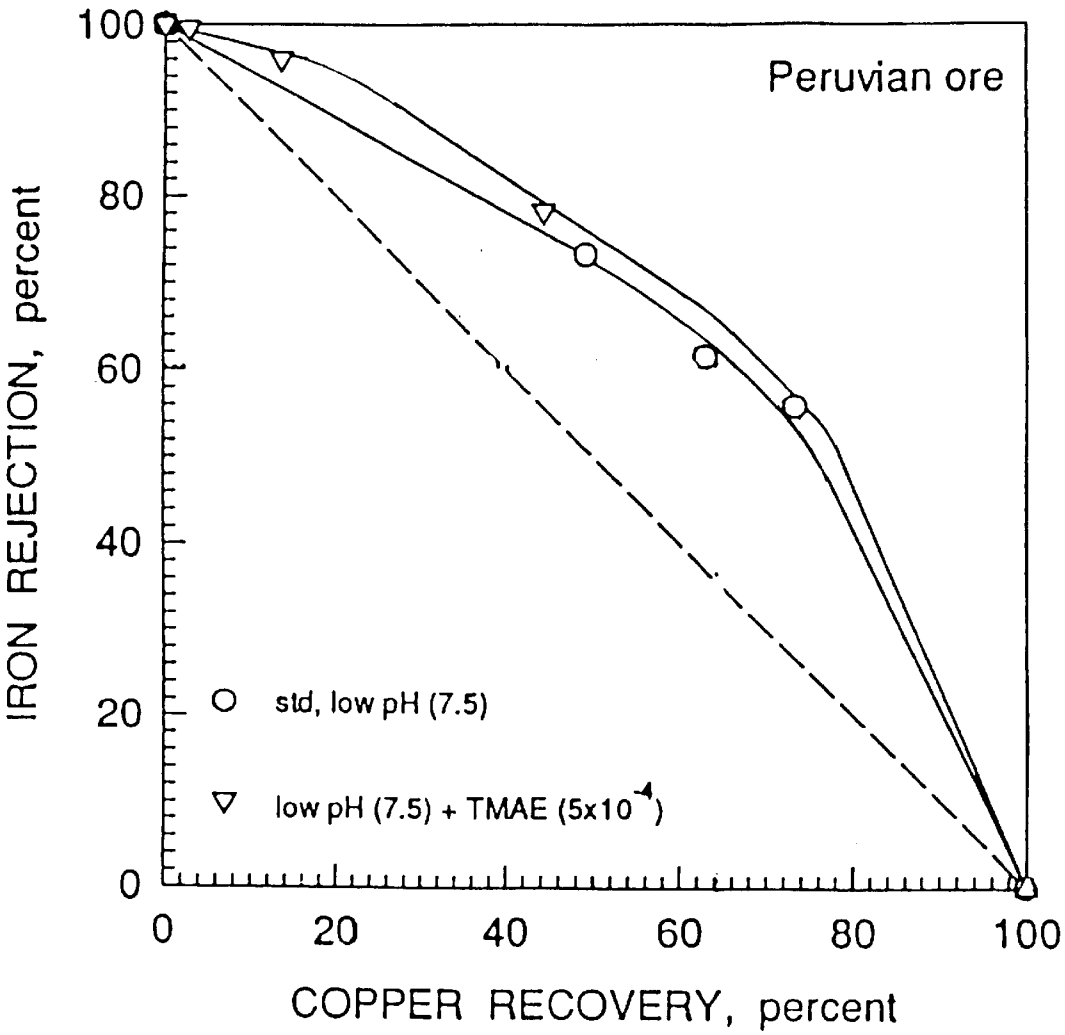

FIG. 6 indicates that TMAE at the concentrations indicated is a better pyrite depressant than a conventional standard such as set forth above. Note in FIG. 6 that at 80% copper recovery the iron rejection is only about 50 per cent. The reason is based on the character of the ore which are termed "locked particle" wherein the pyrite and copper are interlaced in varying amounts. If such particle is floated, then the grade of the copper concentrate is reduced. Similarly, if the particle is depressed, then copper recovery is reduced. In practice, the rougher concentrate represents a smaller portion of the ore and regranting the former leads to increased effectiveness and lower costs. Regrinding liberates more copper and iron minerals.

Whereas there are here specifically set forth certain preferred procedures which are presently regarded as the best mode for carrying out the invention, it should be understood by one skilled in the art, that various changes, modifications and improvements can be made and other procedures adapted without departing from the scope of the invention particularly pointed out and claimed hereinbelow.

For example, a family of compounds having the same characteristics as set forth above of the following general formula, are of likewise extreme value in the prior amounts for use in the processes set forth above:

$$R1, R2, R3\ N^{+}O_2H_4SR4X^{-}$$

where

R1, R2 and R3 are lower alkyls wherein the final sum of the carbon atoms is in a range of 3 to 6, n is between 2 and 4, X is chlorine, Bromine or Iodine, and R4 is selected from a group consisting of hydrogen (H) and amidine.

COMPOUND GHB-2

Figure 7:
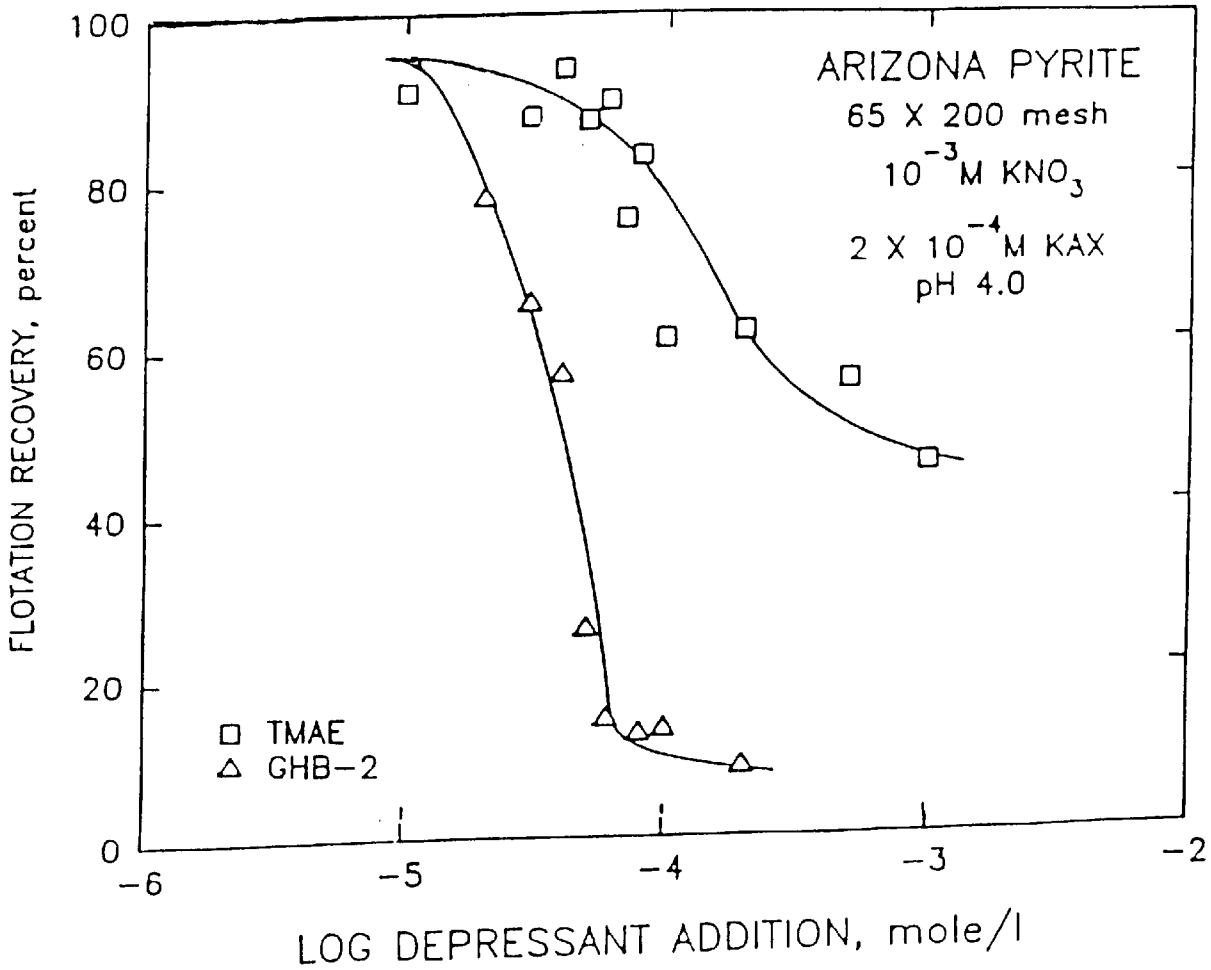

The compound GHB-2 is a compound containing in the molecule one or more nitrilodiacetate groups and nitrilotriacetic acid (NTA) of the following general formula:

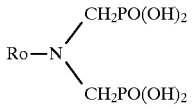

where Ro is a lower alkyl having carbon atoms in a range of 3 to 8 with 3 to 6 being preferred and a final pH in a range of 4 to 9 depending on the ore being processed. Note in FIG. 7, the compound GHB-2 in which Ro is a lower alkyl having six carbon atoms, provides superior results in comparison with TMAE.

Preparation of the compound GH-2 is a set forth in the article entitled "THE DIRECT SYNTHESIS OF ALPHA-AMINOMETHYLPHOSPHONIC ACIDS. MANNISH-TYPE REACTIONS WITH ORTHOPHOSPHOROUS ACID", Kurt Moedritzer et al, Journal of Organic Chemistry, May, 1966.

TABLE 1

| | COAL SAMPLE |
|---|---|
| PARAMETER | Illinois No. 6 |
| Feed Sample | |
| Grinding sample | 500 g |
| Flotation test feed | 125 ± 5 g |
| Method of splitting | riffle |
| Flotation time | 5 minutes |
| Flotation Equipment and Operating Conditions | |
| Machine type | Denver Machine with 2-liter DOE cell |
| Machine rotor speed | 1200 rpm |
| Froth paddle speed | 36 rpm |
| Water | 1000 $cm^3$ |
| Level make up method | manual |
| Cell, level below lip | 20 mm |
| Aeration rate | 4 liters/minute |
| Conditioning Times | |
| Pulping time | 2 minutes |
| Pulp level adj. and pH meas. time | 1 minute |
| Collector cond. time | 1 minute |
| Frother cond. time | 3 minutes |
| Total cond. time | 7 minutes |
| Collector dosage | (100 $\mu$l = 1.20 lb/T) |
| Dodecane | 5.76 lb/T (480 |
| Frother dosage | (100 $\mu$l = 1.30 lb/T) |
| MIBC | 1.17 lb/T (90 $\mu$l) |

We claim:

1. Process for separating pyrite from sulfide ores and coal which comprises subjecting said sulfide ore or coal containing said pyrite to flotation in the presence of a depressant for pyrite, said depressant comprises about 0.05 to 0.75 pounds per ton of a pyrite depressant selected from the group consisting of $$R1, R2, R3\ N^{+}O_2H_4SR4X^{-} \quad (I)$$

where

R1, R2 and R3 are lower alkyls wherein the final sum of the carbon atoms is in a range of 3 to 6, X is chlorine, bromine or iodine, and R4 is amidine.

2. The process of claim 1 in which group (I) is 2-trimethylammonium-ethane isothiuronium dichloride (TMAE).

* * * * *

UNITED STATES PATENT AND TRADEMARK OFFICE
Certificate

Patent No. 5,853,571 Patented: December 29, 1998

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Guy H. Harris, Concord, CA; Douglas W. Fuerstenau, Berkeley, CA; and Francisco J. Sotillo, Lakeland, FL.

Signed and Sealed this Thirtieth Day of July 2002.

DAVID A. SIMMONS
*Supervisory Patent Examiner*
Art Unit 1724